US010619855B2

(12) United States Patent
Brogan et al.

(10) Patent No.: US 10,619,855 B2
(45) Date of Patent: Apr. 14, 2020

(54) FUEL DELIVERY SYSTEM WITH A CAVITY COUPLED FUEL INJECTOR

(71) Applicant: United Technologies Corporation, Hartford, CT (US)

(72) Inventors: Torence P. Brogan, Manchester, CT (US); Jeffery A. Lovett, Tolland, CT (US); Christopher A. Eckett, West Hartford, CT (US); May L. Corn, Manchester, CT (US)

(73) Assignee: United Technologies Corporation, Farmington, CT (US)

( * ) Notice: Subject to any disclaimer, the term of this patent is extended or adjusted under 35 U.S.C. 154(b) by 952 days.

(21) Appl. No.: 13/936,836

(22) Filed: Jul. 8, 2013

(65) Prior Publication Data

US 2014/0060059 A1 Mar. 6, 2014

Related U.S. Application Data

(60) Provisional application No. 61/697,650, filed on Sep. 6, 2012.

(51) Int. Cl.
*F23R 3/28* (2006.01)
*F23R 3/20* (2006.01)

(52) U.S. Cl.
CPC . *F23R 3/28* (2013.01); *F23R 3/20* (2013.01)

(58) Field of Classification Search
CPC ..... F23R 3/20; F23R 3/28; F02C 7/22; F02C 7/222; F02C 7/228
See application file for complete search history.

(56) References Cited

U.S. PATENT DOCUMENTS 3,053,461 A * 9/1962 Inglis ..... B05B 7/1281 137/624.14
3,693,354 A * 9/1972 Hull, Jr. ..... F23R 3/20 415/79
3,693,889 A * 9/1972 Schuster ..... F02M 61/02 239/124
3,777,983 A * 12/1973 Hibbins ..... F23D 11/10 239/406
3,886,736 A * 6/1975 Kawaguchi ..... F23R 3/14 239/400
4,134,260 A * 1/1979 Lefebvre ..... F23R 3/22 60/262
4,305,255 A * 12/1981 Davies ..... F02C 7/22 60/741
5,129,226 A 7/1992 Bigelow et al.
5,423,178 A * 6/1995 Mains ..... F23D 11/36 239/132.5
5,568,721 A * 10/1996 Alary ..... F23D 11/28 60/746
5,836,163 A * 11/1998 Lockyer ..... F23D 11/107 239/405
5,873,237 A * 2/1999 Medla ..... F23D 11/107 60/740

(Continued)

*Primary Examiner* — Carlos A Rivera
(74) *Attorney, Agent, or Firm* — Getz Balich LLC

(57) ABSTRACT

A fuel injection system for a gas turbine engine includes a fuel delivery conduit, a nozzle block with a nozzle aperture, and a cavity block with a cavity. The nozzle aperture has a first cross sectional area, and injects fuel received from the fuel delivery conduit into the cavity. The cavity has a second cross sectional area that is greater than the first cross sectional area.

13 Claims, 6 Drawing Sheets

(56) References Cited

U.S. PATENT DOCUMENTS

| | | | | |
|---|---|---|---|---|
| 6,490,864 | B1 | 12/2002 | Joos et al. | |
| 6,672,066 | B2 * | 1/2004 | Wrubel | F23R 3/283 60/39.281 |
| 7,870,736 | B2 | 1/2011 | Homitz et al. | |
| 7,891,191 | B2 * | 2/2011 | Yoshida | F23D 11/104 60/39.23 |
| 7,954,328 | B2 | 6/2011 | Atassi | |
| 2006/0213180 | A1 * | 9/2006 | Koshoffer | F02K 3/10 60/226.1 |
| 2007/0044476 | A1 * | 3/2007 | Koshoffer | F23R 3/20 60/776 |
| 2009/0260365 | A1 | 10/2009 | Muldoon et al. | |
| 2010/0281871 | A1 * | 11/2010 | Hadley | F23D 14/58 60/737 |
| 2011/0289928 | A1 * | 12/2011 | Fox | F23R 3/286 60/740 |
| 2011/0296839 | A1 * | 12/2011 | Van Nieuwenhuizen | F23R 3/346 60/737 |
| 2013/0098048 | A1 * | 4/2013 | Popovic | F23D 14/24 60/772 |

* cited by examiner

FUEL DELIVERY SYSTEM WITH A CAVITY COUPLED FUEL INJECTOR

Applicant hereby claims priority to U.S. Patent Application No. 61/697,650 filed Sep. 6, 2012, the disclosure of which is herein incorporated by reference.

This invention was made with government support under Contract No. N00019-02-C-3003 awarded by the United States Navy. The government may have certain rights in the invention.

BACKGROUND OF THE INVENTION

1. Technical Field

The present invention relates generally to a turbine engine and, in particular, to a turbine engine fuel delivery system with one or more fuel injectors.

2. Background Information

A gas turbine engine may include an augmentor section that provides supplemental engine thrust during certain operating conditions. The augmentor section may include a plurality of fuel injectors respectively arranged with one or more stator vanes that condition core gas exiting a turbine section. The fuel injectors inject fuel into the core gas for combustion and, thus, provision of the supplemental engine thrust. Typically, the injected fuel penetrates deep into the core gas to increase mixing between the fuel and the core gas. This deep fuel penetration may increase augmentor efficiency as well as the magnitude of the supplemental engine thrust. Such deep fuel penetration, however, may decrease the amount of atomized fuel proximate the vane walls. Such a decrease in the amount of atomized fuel may negatively impact flame stability proximate the vane walls and increase screech within the augmentor section.

SUMMARY OF THE DISCLOSURE

According to an aspect of the invention, a fuel injection system is provided for a gas turbine engine. The system includes a fuel delivery conduit, a nozzle block with a nozzle aperture, and a cavity block with an airflow aperture and a cavity. The nozzle aperture has a first cross sectional area, and injects fuel received from the fuel delivery conduit into the cavity. The airflow aperture directs air to the cavity that mixes with the injected fuel. The cavity has a second cross sectional area that is greater than the first cross sectional area.

In one embodiment, the fuel injection system also includes a gas path wall with a wall aperture that extends through the wall. The wall aperture is fluidly coupled to the nozzle aperture and the airflow aperture through the cavity. In some embodiments, the wall aperture includes a third cross sectional area that is greater than the second cross sectional area.

In one embodiment, the cavity block extends between the gas path wall and the nozzle block.

In one embodiment, the cavity block also includes a cavity aperture into which at least a portion of the nozzle block extends, where the cavity is defined within the cavity aperture adjacent to the nozzle block.

In one embodiment, the fuel injection system also includes a biasing element that pushes the cavity block away from the fuel delivery conduit.

In one embodiment, an end of the nozzle block includes a notch with a side notch surface and a bottom notch surface, and the nozzle block includes a second airflow aperture that directs the air from the airflow aperture into the cavity. An outlet of the second airflow aperture is located with the side notch surface, and an outlet of the nozzle aperture is located with the bottom notch surface.

In one embodiment, at least a portion of an outlet of the airflow aperture is located with an interior surface of the cavity.

In one embodiment, the cavity extends into the cavity block from a cavity block end, and at least a portion of an outlet of the airflow aperture is located with the cavity block end.

In one embodiment, the cavity has a circular cross sectional geometry. In another embodiment, the cavity has an elongated cross sectional geometry.

In one embodiment, the cavity extends from a first cavity end that is adjacent to the nozzle block to a second cavity end. The first cavity end has the second cross sectional area, and the second cavity end has a third cross sectional area. The third cross sectional area may be greater than, equal to, or less than the second cross sectional area.

According to another aspect of the invention, a fuel injection system is provided for a gas turbine engine. The system includes a gas path wall with a wall aperture extending therethrough, a nozzle block with a nozzle aperture having a first cross sectional area, and a cavity block that extends between the gas path wall and the nozzle block. The cavity block includes a cavity with a second cross sectional area that is greater than the first cross sectional area. The nozzle aperture injects fuel received from a fuel delivery conduit through the cavity and the wall aperture.

In one embodiment, the cavity block also includes an airflow aperture that directs cooling air to the cavity that mixes with the injected fuel.

According to another aspect of the invention, a fuel injection system is provided for a gas turbine engine. The system includes a gas path wall with a wall aperture extending therethrough, a nozzle block with a nozzle aperture having a first cross sectional area, and a cavity block with a cavity. The cavity has an elongated cross sectional geometry and a second cross sectional area that is greater than the first cross sectional area. The nozzle aperture injects fuel received from a fuel delivery conduit through the cavity and the wall aperture.

In one embodiment, the cavity block also includes an airflow aperture that directs cooling air to the cavity that mixes with the injected fuel.

In one embodiment, the system also includes a biasing element that engages the cavity block with the gas path wall. The cavity block also includes a cavity aperture into which at least a portion of the nozzle block extends, where the cavity is defined within the cavity aperture adjacent to the nozzle block.

The foregoing features and the operation of the invention will become more apparent in light of the following description and the accompanying drawings.

DETAILED DESCRIPTION OF THE INVENTION

Figure 1:
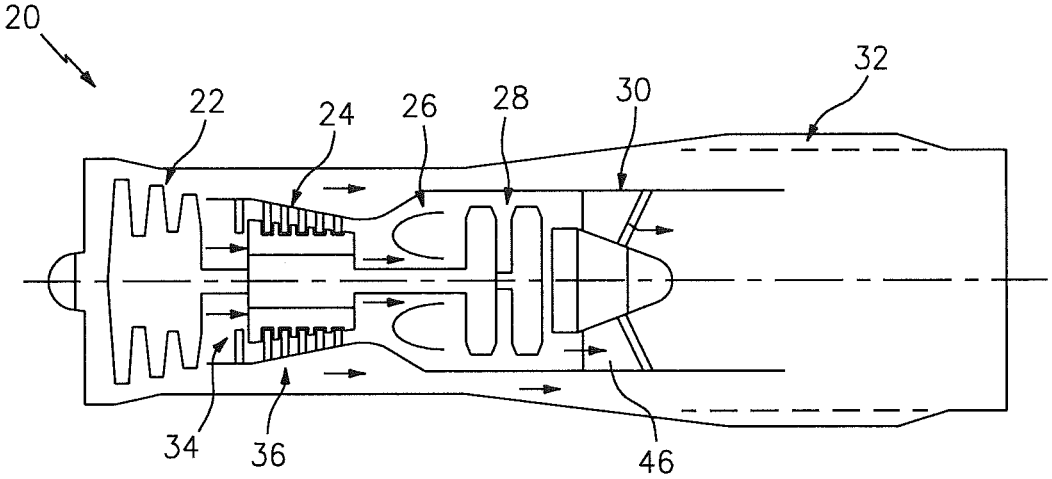
FIG. 1 is a sectional illustration of a gas turbine engine.

FIG. 1 illustrates a gas turbine engine 20 that includes a fan section 22, a compressor section 24, a combustor section 26, a turbine section 28, an augmentor section 30 and a nozzle section 32. Air entering the engine 20 is directed through the fan section 22 and into a core gas path 34 and a bypass gas path 36. The air within the core gas path 34 may be referred to a "core air", and the air within the bypass gas path 36 may be referred to as "bypass air" or "cooling air". The core air is directed through the compressor section 24, the combustor section 26, the turbine section 28, the augmentor section 30 and the nozzle section 32 before exiting the engine 20. Fuel is injected into and mixed with the core air within the combustor section 26 and/or the augmentor section 30 and subsequently ignited to provide engine thrust. The bypass air may be utilized to cool (e.g., impingement cool, film cool, etc.) various turbine engine components. The bypass air may also be utilized to enhance fuel combustion within the combustor section 26 and/or the augmentor section 30, which is described below in further detail.

Figure 2:
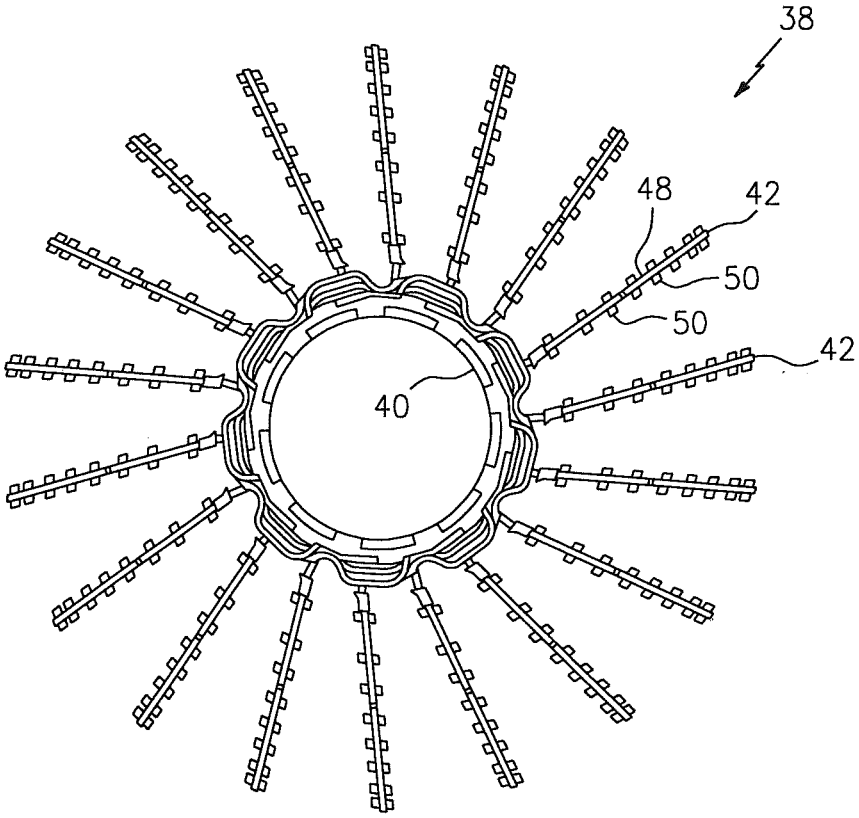
FIG. 2 is a front view illustration of an augmentor fuel delivery system.
Figure 3:
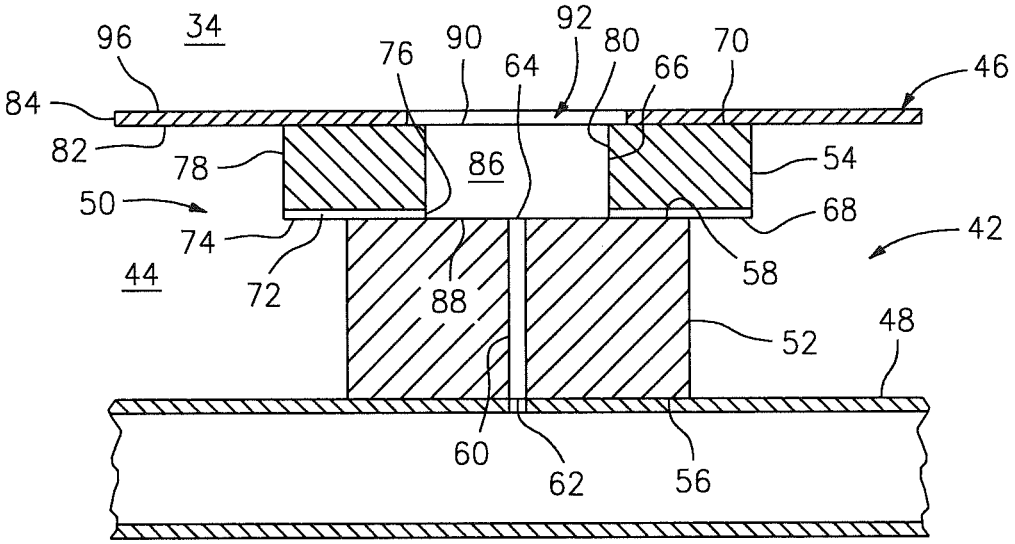
FIG. 3 is a partial sectional illustration of a fuel delivery system spray bar.

FIG. 2 illustrates an augmentor fuel delivery system 38 that is included in the augmentor section 30. The fuel delivery system 38 includes a fuel delivery manifold 40 that provides fuel to one or more augmentor spray bars 42. The spray bars 42 may be arranged circumferentially around the fuel delivery manifold 40. Referring to FIGS. 1, 2 and 3, each of the spray bars 42 extends through an inner cavity 44 of a respective augmentor vane 46, which may be fluidly coupled with and receive bypass air from the bypass gas path 36.

Figure 4:
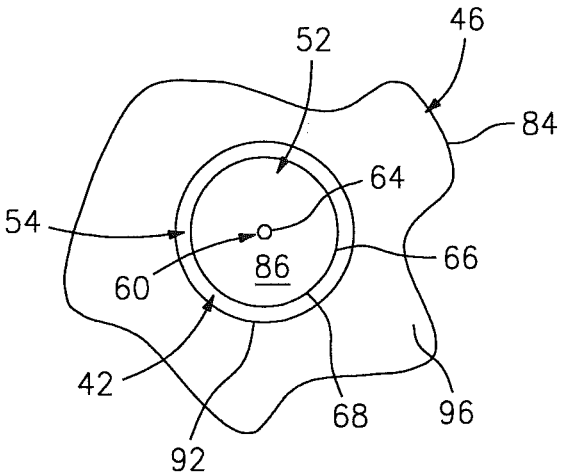
FIG. 4 is a partial illustration of a fuel delivery system spray bar as viewed from an engine gas path.

FIG. 3 illustrates a portion of one of the spray bars 42 within the inner cavity 44 of a respective one of the augmentor vanes 46. FIG. 4 illustrates the spray bar 42 of FIG. 3 as viewed from the core gas path 34. Referring to FIGS. 3 and 4, each of the spray bars 42 may include a (e.g., tubular) spray bar fuel delivery conduit 48 and one or more cavity coupled fuel injectors 50. Each of the fuel injectors 50 includes a spray bar nozzle block 52 and a spray bar cavity block 54.

The nozzle block 52 extends longitudinally (e.g., axially) between a first nozzle block end 56 and a second nozzle block end 58. The nozzle block 52 includes a fuel injection nozzle aperture 60 that extends through the nozzle block 52 between a nozzle aperture inlet 62 and a nozzle aperture outlet 64. The nozzle aperture inlet 62 may be located with the first nozzle block end 56. The nozzle aperture outlet 64 may be located with the second nozzle block end 58. The nozzle aperture outlet 64 has a (e.g., circular) cross sectional geometry, which defines a nozzle aperture cross sectional area.

Figure 5:
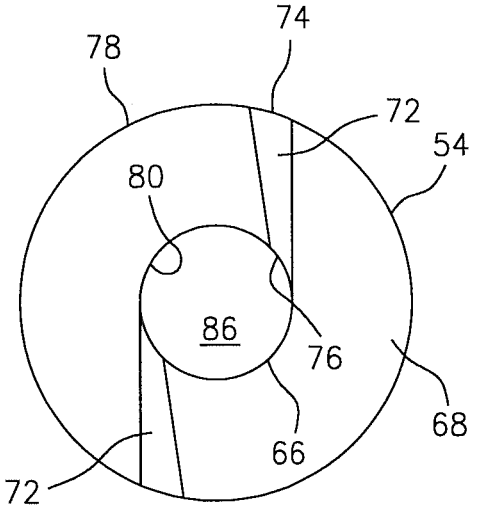
FIG. 5 is an illustration of an end of a cavity block.

The cavity block 54 includes a cavity aperture 66 that extends longitudinally between a first cavity block end 68 and a second cavity block end 70. Referring to FIGS. 3 and 5, the cavity block 54 may also include one or more airflow apertures 72. Each of the airflow apertures 72 extends through a cavity block sidewall from an airflow aperture inlet 74 to an airflow aperture outlet 76. The airflow aperture inlet 74 may be located with the first cavity block end 68 and/or a laterally exterior cavity block surface 78. The airflow aperture outlet 76 may be located with a laterally interior cavity block surface 80. In the embodiment of FIGS. 3 and 5, each of the airflow apertures 72 is configured as a channel that extends longitudinally into the cavity block 54 at the first cavity block end 68.

Referring to FIG. 3, the first nozzle block end 56 is connected to the fuel delivery conduit 48. The cavity block 54 extends and is connected between the second nozzle block end 58 and an inner cavity surface 82 of a gas path wall 84 of a respective one of the augmentor vanes 46.

Referring to FIGS. 3 and 4, a cavity 86 (e.g., a fuel mixing and atomization cavity) is defined within the cavity aperture 66 longitudinally between a first cavity end 88 and a second cavity end 90. The cavity 86 fluidly couples (i) the nozzle aperture 60 and/or the airflow apertures 72 to (ii) a wall aperture 92 that extends through the gas path wall 84. The first cavity end 88 is located with the first cavity block end 68. The first cavity end 88 has a (e.g., circular) cross sectional geometry, which defines a first cavity cross sectional area that is greater than the nozzle aperture cross sectional area. The second cavity end 90 is located with the second cavity block end 70. The second cavity end 90 has a (e.g., circular) cross sectional geometry, which defines a second cavity cross sectional area that is greater than the nozzle aperture cross sectional area. In the specific embodiment of FIGS. 3 and 4, the first cavity cross sectional area and the second cavity cross sectional area are substantially equal, and less than a cross sectional area of the wall aperture 92.

Figure 6:
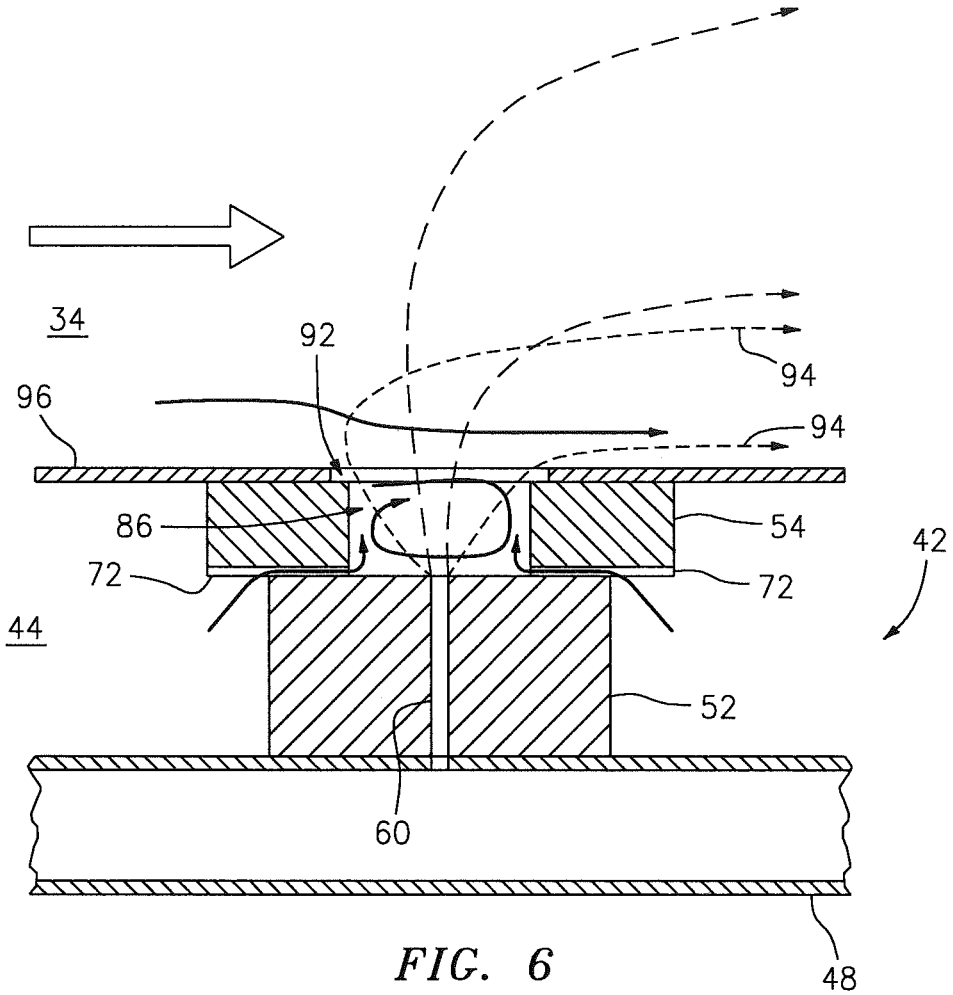
FIG. 6 is a partial sectional illustration of the spray bar of FIG. 3 during a mode of engine operation.
Figure 7:
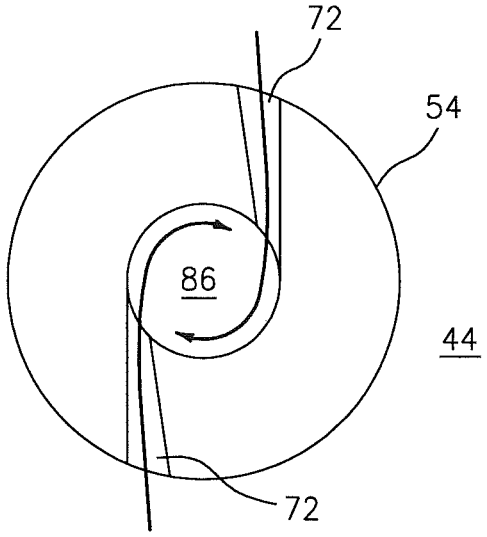
FIG. 7 is an illustration of the cavity block of FIG. 5 during a mode of engine operation.

FIG. 6 illustrates fuel flow and airflow through and around the spray bar 42 during a mode of engine operation. FIG. 7 illustrates airflow through the cavity block 54 during the mode of engine operation. Referring to FIGS. 6 and 7, the nozzle aperture 60 injects fuel (e.g., liquid fuel) received from the fuel delivery conduit 48 through the cavity 86 and the wall aperture 92 and into the core gas path 34 in the augmentor section 30 (see FIG. 1). A pressure differential between the core gas path 34 and the cavity 86 may cause a portion of the core gas to enter and circulate within the cavity 86. The circulating core gas may create airflow instabilities within the cavity 86. Airflow instabilities (e.g., a vortex, etc.) may also be created by a portion of the bypass air that is directed into the cavity 86 by the airflow apertures 72. These airflow instabilities may strip relatively fine droplets of fuel away from the injected fuel stream and thereby atomize a relatively small portion of the injected fuel within the cavity 86. The atomized fuel 94 may flow from the cavity 86 and into the core gas path 34 adjacent to a core gas path surface 96 of the gas path wall 84. Increasing the atomized fuel concentration adjacent to the core gas path surface 96 may anchor a respective flame, generated from combusting the injected fuel, to the core gas path surface 96.

Increasing the atomized fuel concentration adjacent to the core gas path surface 96 may also increase flame stability proximate to the core gas path surface 96 as well as reduce screech within the engine.

Figure 8:
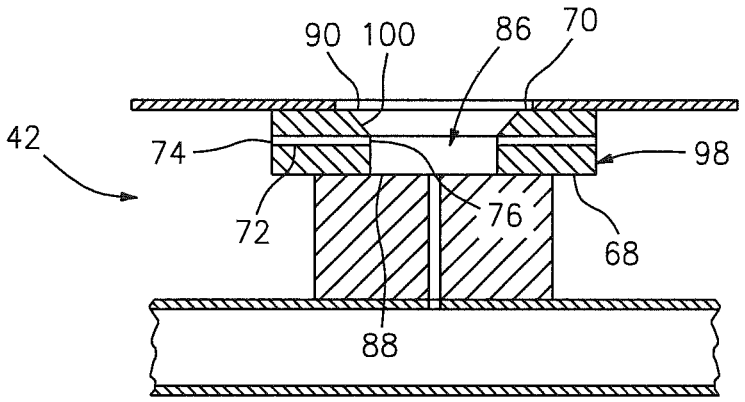
FIG. 8 is a partial sectional illustration of another fuel delivery system spray bar.

FIG. 8 illustrates a portion of the spray bar 42 with another cavity block 98 embodiment. In contrast to the cavity block 54 illustrated in FIG. 3, the cavity block 98 includes a sloped (e.g., chamfered or beveled) cavity aperture surface 100 that extends from the second cavity block end 70 towards (or to) the first cavity block end 68. A pitch of the cavity aperture surface 100 may be substantially uniform (or non-uniform) around its circumference. The cavity aperture surface 100 forms the cavity 86 with a non-uniform chamfered (or beveled) sectional geometry. The second cavity cross sectional area of the second cavity end 90, for example, is greater than the first cavity cross sectional area of the first cavity end 88. In addition to the foregoing, the airflow apertures 72 in the cavity block 98 are positioned longitudinally between and spaced from the first cavity block end 68 and the second cavity block end 70.

Figure 9:
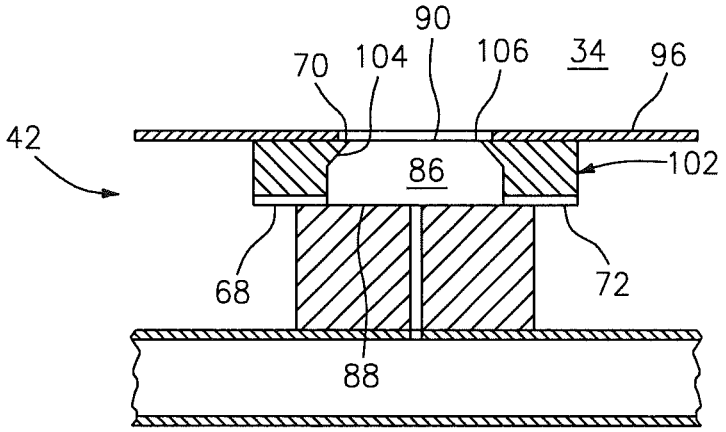
FIG. 9 is a partial sectional illustration of still another fuel delivery system spray bar.

FIG. 9 illustrates a portion of the spray bar 42 with another cavity block 102 embodiment. In contrast to the cavity block 54 illustrated in FIG. 3, the cavity block 102 includes a sloped (e.g., lipped or funneled) cavity aperture surface 104 that extends from the second cavity block end 70 towards (or to) the first cavity block end 68. The cavity aperture surface 104 forms the cavity 86 with a non-uniform lipped sectional geometry. The first cavity cross sectional area of the first cavity end 88, for example, is greater than the second cavity cross sectional area of the second cavity end 90. During engine operation, a portion of the injected fuel may collect at a lip 106 defined by the second cavity end 90. The collected fuel may be atomized by the core gas proximate to the core gas path surface 96, and thereby increase the atomized fuel concentration adjacent to the core gas path surface 96.

Figure 10:
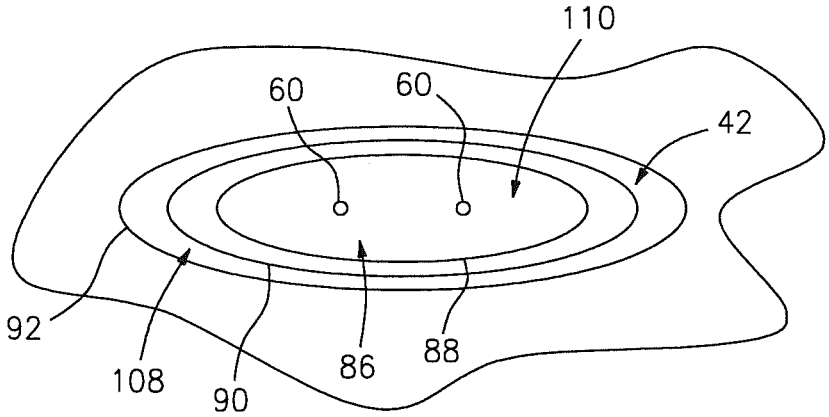
FIG. 10 is a partial illustration of another fuel delivery system spray bar as viewed from the engine gas path.

FIG. 10 illustrates a portion of the spray bar 42 with another cavity block 108 embodiment as viewed from the core gas flow path 34. In contrast to the cavity block 54 illustrated in FIG. 4, the cavity block 108 defines the (e.g., chamfered) cavity 86 with an elongated oval cross sectional geometry. Examples of other elongated cross sectional geometries include elliptical, race track, rectangular, etc. cross sectional geometries. FIG. 10 also illustrates another nozzle block 110 embodiment. In contrast to the nozzle block 52 illustrated in FIG. 4, the nozzle block 110 includes a plurality of nozzle apertures 60 that inject fuel through the cavity 86 into the core gas path 34. In alternative embodiments, one or more of the nozzle apertures 60 may have an elongated (e.g., oval, elliptical, rectangular, etc.) cross sectional geometry.

Figure 11:
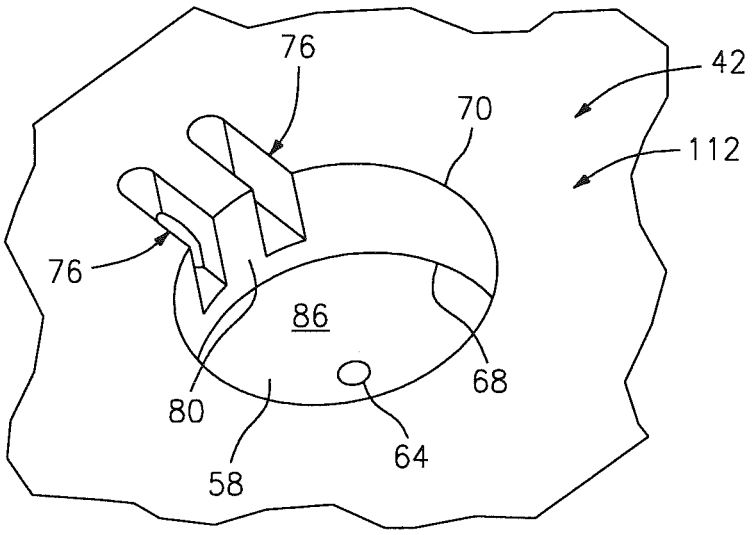
FIG. 11 is a partial perspective illustration of another fuel delivery system spray bar.

FIG. 11 illustrates a portion of the spray bar 42 with another cavity block 112 embodiment. In contrast to the cavity block 54 illustrated in FIG. 3, the airflow aperture outlets 76 of the cavity block 112 are located with the second cavity block end 70 and/or the interior cavity block surface 80.

FIGS. 12-16 illustrate portions of another spray bar 114 embodiment. In contrast to the spray bar 42 illustrated in FIG. 3, at least a portion of the nozzle block 52 extends into the cavity aperture 66. The cavity 86 therefore is defined within the cavity aperture 66 between the nozzle block 52 and the wall aperture 92 (not shown).

A notch 116 (e.g., a channel) may extend into the nozzle block 52 from the second nozzle block end 58. The notch 116 has a bottom notch surface 118 and one or more side notch surfaces 120. The bottom notch surface 118 extends between the side notch surfaces 120. The nozzle aperture outlet 64 is located with the bottom notch surface 118. An airflow aperture outlet 122 of a respective one or more second airflow apertures is located with the side notch surface 120. The second airflow apertures extend laterally through a sidewall of the nozzle block 52, and are fluidly coupled to the airflow aperture 72 in the cavity block 54.

Figure 12:
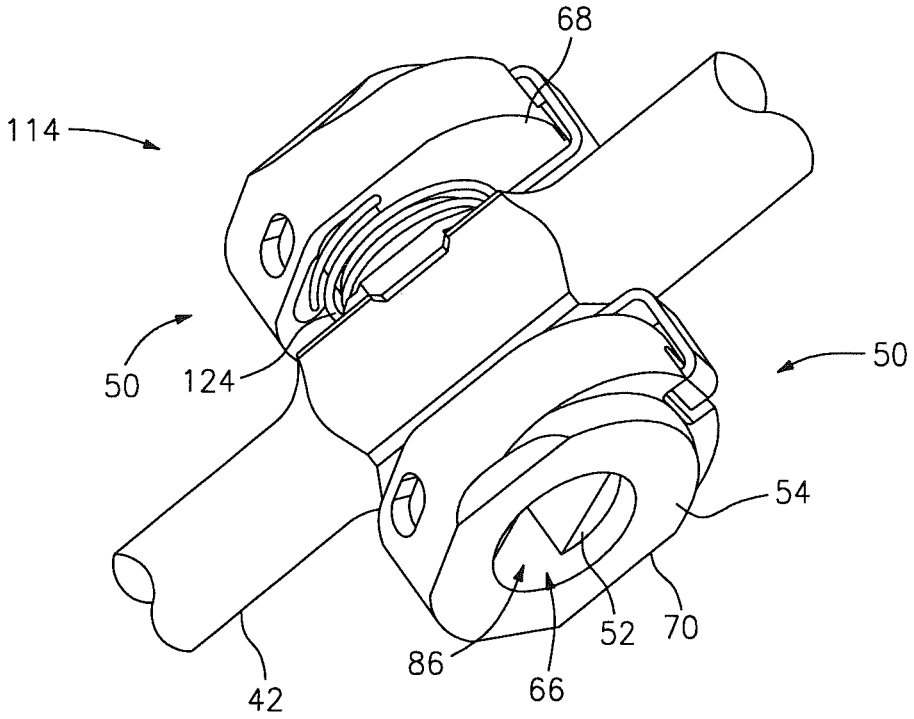
FIG. 12 is a partial perspective illustration of still another fuel delivery system spray bar.
Figure 13:
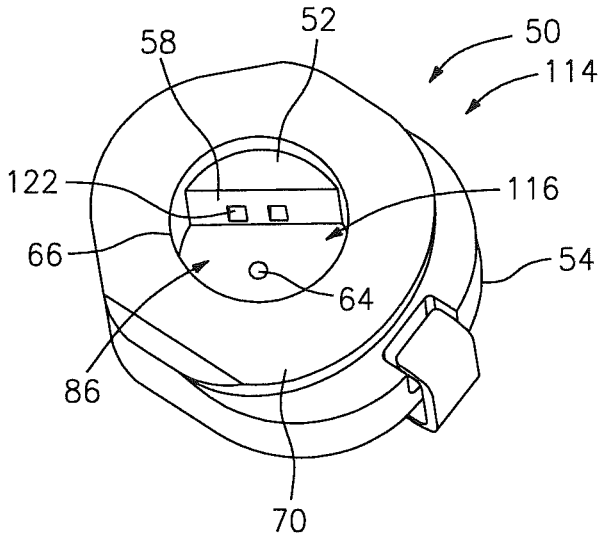
FIG. 13 is a perspective illustration of a cavity coupled fuel injector included in the spray bar of FIG. 12.
Figure 14:
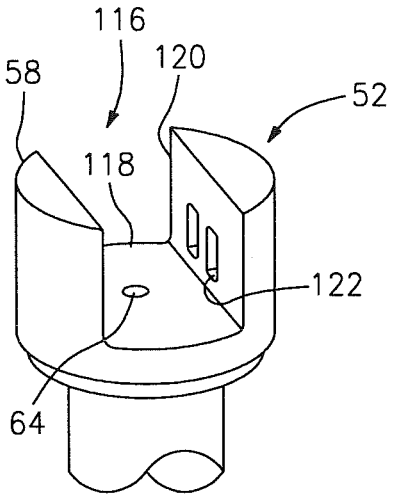
FIG. 14 is a perspective illustration of an nozzle block included in the fuel injector of FIG. 13
Figure 15:
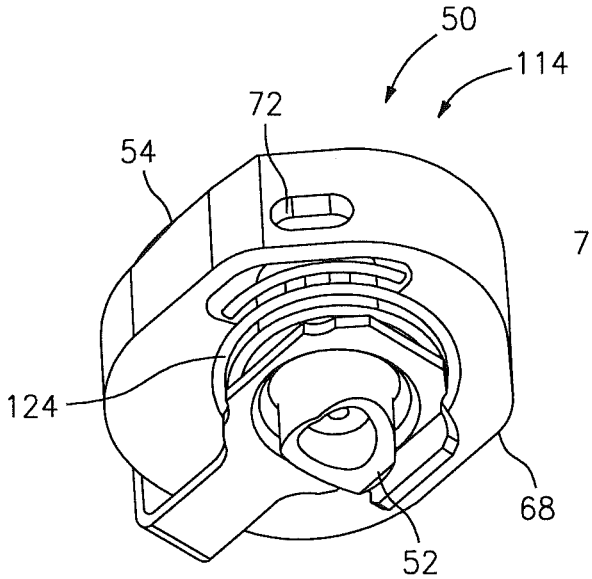
FIG. 15 is another perspective illustration of the fuel injector included in the spray bar of FIG. 12.
Figure 16:
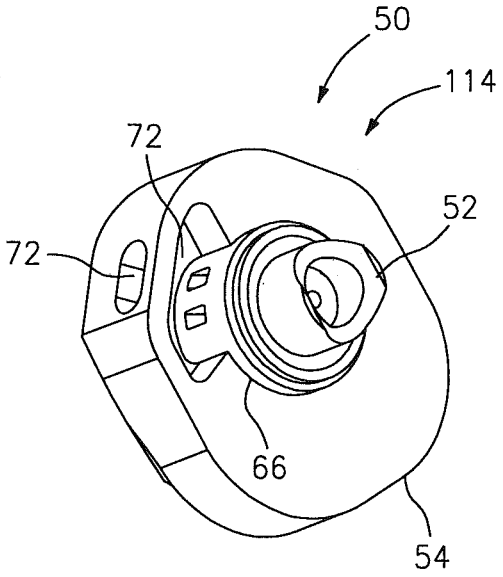
FIG. 16 is another perspective illustration of the fuel injector included in the spray bar of FIG. 12.

Referring to FIGS. 12 and 15, a biasing element 124 (e.g., a coil spring) may be arranged around the nozzle block 52 and between the fuel delivery conduit 42 and the first cavity block end 68. The biasing element 124 pushes the first cavity block end 68 away from the fuel delivery conduit 42, which thereby pushes the second cavity block end 70 against the gas path wall 84 (not shown).

A person of ordinary skill in the art will recognize that the components of the afore-described spray bars may have alternative sizes, geometries and/or configurations than those described above and illustrated in drawings. The cross-sectional geometries, numbers of, and/or configurations of the cavity and/or apertures, for example, may be tailored to enhance pre-existing engine design parameters, manufacturability, etc. A person of ordinary skill in the art will also recognize the afore-described fuel delivery system may be utilized in engine sections other than the augmentor section; e.g., in the combustor section.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined within any one of the aspects and remain within the scope of the invention. Accordingly, the present invention is not to be restricted except in light of the attached claims and their equivalents.

What is claimed is:

1. A fuel injection system for a gas turbine engine, comprising:

a fuel delivery conduit;

a plurality of cavity coupled fuel injectors fluidly coupled with and arranged along a length of the fuel delivery conduit, a first of the cavity coupled fuel injectors including:

a nozzle block comprising a nozzle aperture with a first cross sectional area, the nozzle aperture extending longitudinally through the nozzle block along a longitudinal centerline; and a cavity block comprising an airflow aperture and a cavity with a second cross sectional area that is greater than the first cross sectional area, a surface of the cavity block longitudinally contacting a surface of the nozzle block along the longitudinal centerline, wherein the surface of the cavity block and the surface of the nozzle are perpendicular to the longitudinal centerline;

wherein the nozzle aperture injects fuel received from the fuel delivery conduit into the cavity, and the airflow aperture directs air to the cavity that mixes with the injected fuel.

2. The system of claim 1, further comprising a gas path wall comprising a wall aperture that extends therethrough, wherein the cavity fluidly couples the nozzle aperture and the airflow aperture to the wall aperture.

3. The system of claim 2, wherein the wall aperture comprises a third cross sectional area that is greater than the second cross sectional area.

4. The system of claim 2, wherein the cavity block extends between the gas path wall and the nozzle block.

5. The system of claim 1, wherein at least a portion of an outlet of the airflow aperture is located with an interior surface of the cavity.

6. The system of claim 1, wherein the cavity extends into the cavity block from a cavity block end, and at least a portion of an outlet of the airflow aperture is located with the cavity block end.

7. The system of claim 1, wherein the cavity comprises a circular cross sectional geometry.

8. The system of claim 1, wherein the cavity extends from a first cavity end that is adjacent to the nozzle block to a second cavity end, and Wherein the first cavity end comprises the second cross sectional area, and the second cavity end comprises a third cross sectional area that is substantially equal to the second cross sectional area.

9. A fuel injection system for a gas turbine engine, comprising:

a gas path wall comprising a wall aperture extending therethrough;

a nozzle block comprising a nozzle aperture with a first cross sectional area, the nozzle aperture extending axially along a centerline through the nozzle block; and a cavity block that extends axially along the centerline between and axially engages the gas path wall and the nozzle block, and the cavity block comprises a cavity with a second cross sectional area that is greater than the first cross sectional area, wherein a surface of the cavity block contacts a surface of the nozzle block, and wherein the surface of the cavity block and the surface of the nozzle block are not parallel with the centerline;

wherein the nozzle aperture injects fuel, received from a fuel delivery conduit, through the cavity and the wall aperture.

10. The system of claim 9, wherein the cavity block further comprises an airflow aperture that directs cooling air to the cavity that mixes with the injected fuel.

11. A fuel injection system for a gas turbine engine, comprising:

a fuel delivery conduit;

a wall including a wall aperture extending through the wall; and a cavity coupled fuel injector with a centerline, the cavity coupled fuel injector including a nozzle block and a cavity block;

the nozzle block including a nozzle aperture with a first cross sectional area, the nozzle aperture extending axially along the centerline through the nozzle block;

the cavity block including an airflow aperture and a cavity with a second cross sectional area that is greater than the first cross sectional area; and the cavity coupled fuel injector configured to inject fuel, received from the fuel delivery conduit, into a volume on an opposite side of the wall from the cavity coupled fuel injector for ignition and combustion within the volume, wherein the fuel is directed sequentially through the nozzle aperture, the cavity and the wall aperture along an axially unobstructed trajectory;

wherein a surface of the cavity block axially engages a surface of the nozzle block, and wherein the surface of the cavity block and the surface of the nozzle block are perpendicular to the centerline.

12. The system of claim 11, wherein the cavity block extends axially between and axially engages the wall and the nozzle block.

13. The system of claim 11, further comprising:

a plurality of fuel injectors fluidly coupled with and arranged along a length of the fuel delivery conduit, wherein the fuel injectors comprise the cavity coupled fuel injector; and a vane including the wall.

* * * * *